United States Patent [19]

Suzuki

[11] 4,410,019

[45] Oct. 18, 1983

[54] BINDING TOOL

[75] Inventor: Tadashi Suzuki, Saitama, Japan

[73] Assignee: Satogosei Co., Ltd., Tokyo, Japan

[21] Appl. No.: 366,521

[22] Filed: Apr. 7, 1982

[30] Foreign Application Priority Data

May 29, 1981 [JP] Japan ..... 56/81090

[51] Int. Cl.[3] ..... B21F 9/00

[52] U.S. Cl. ..... 140/123.6; 140/93.2

[58] Field of Search ..... 140/93.2, 123.6

[56] References Cited

U.S. PATENT DOCUMENTS 3,661,187 5/1972 Caveney et al. ..... 140/123.6

3,830,263 8/1974 Benfer ..... 140/93.2

*Primary Examiner*—Lowell A. Larson

*Assistant Examiner*—Linda McLaughlin

*Attorney, Agent, or Firm*—Mason, Fenwick & Lawrence

[57] ABSTRACT

There is disclosed a binding tool for fastening and cutting off a band such as a plastic binding band after relaxing the pulling force which includes a pistol-type body, a trigger part subjected to a returning force, a pulling member slidably disposed in the body, a sliding member slidably disposed along a slot of the pulling member and connected to the trigger part through a pivoted connecting member, a push-up member having a tapered surface slidably contacting a tapered surface of the sliding member and a surface slidably contacting an inner surface of a rear end portion of the pulling member. The sliding contact between the tapered surfaces is released when forces imposed reaches a predetermined value. The tool includes a rocking member provided at a tip with a cutter, and a push-down member having a sloped surface slidably contacting a sloped surface formed in the under portion of the pulling member, a face slidably contacting the upper surface of the rocking member, and a face coming into slidable contact with a pressing surface provided on the under side of the sliding member after release from contact of the tapered surfaces of the sliding member and push-up member.

2 Claims, 11 Drawing Figures

BINDING TOOL

FIELD OF THE INVENTION

This invention relates to a binding tool wherein such binding band as a cable tie made of a plastic for binding electric cables and other materials is fastened as tensioned under a predetermined strength and is then cut off at the free end under a reduced tension by once relaxing the pulling force just before the band is cut off.

DESCRIPTION OF THE PRIOR ART

Generally pistol-type binding tools are known. A pistol-type binding tool provided with a pulling mechanism and cutting mechanism is disclosed in the gazette of Japanese Patent Publication No. 16833/1966 filed by claiming the priority right based on U.S. patent application Ser. No. 474,563 of July 26, 1965 of Jack E. Caveney et al. and a pistol-type binding tool provided with a pulling mechanism and cutting mechanism so that the pulling mechanism will be driven through an operating mechanism without contacting the cutting mechanism until a fixed tension is obtained and will be driven through a toggle link device contracting against the cutting mechanism when the fixed tension is obtained to operate the cutting mechanism is disclosed in the gazette of Japanese Patent Laid Open No. 116399/1977 filed by claiming the priority right based on U.S. patent application Ser. No. 656,489 of Feb. 9, 1976 of Joseph Romeo Paradis. These conventional binding tools have defects that, generally, the band will be cut off at the free end at the maximum peak of the band fastening tension and will be pulled out of a socket part containing a ratchet mechanism formed at one end of the band as engaged by the pulling cutting shock or will be so abnormal in the engagement with the socket part as to be likely to be disengaged even if not pulled out.

The present invention has it as an object to engage a band with a socket part by once momentarily relaxing the pulling force just before cutting the band after fastening and pulling it to prevent the return of the band when cut and to securely bind it.

Another object of the present invention is to make the remaining length after cutting the band adjustable to further securely engage the band.

Further, another object of the present invention is to make the manufacture easy with a simple structure and to improve and rationalize the workability with a light weight.

SUMMARY OF THE INVENTION

The present invention relates to a binding tool comprising a trigger part given a returning force and connected to a pistol-type body capable of being fitted with a pad plate at the tip, a sliding member operatively connected to the trigger part, a push-up member taper-contacting the rear end portion of the sliding member and given a push-up force, a pulling member connected to the push-up member and provided at the tip with ratchet pawls engaging the free end portion of a binding band, a rocking member provided at the tip with a cutter so as to slide with the above mentioned pad plate and a push-down member slidable on the upper surface of the rear end portion of the rocking member and having a sloped surface, the push-down member being pressed and pushed down between the above mentioned sliding member and tensioning member.

In one mode of the present invention, the above mentioned push-down member is arranged with a gap from the pressing surface of the sliding member and in tapered contact with the pulling member.

BRIEF DESCRIPTION OF THE DRAWINGS

An embodiment of the present invention is shown in the drawings in which.

DETAILED DESCRIPTION OF THE INVENTION

Figure 4:
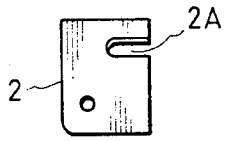
FIG. 4 is an elevation of a pad plate to be fitted to the tip.
Figure 5:
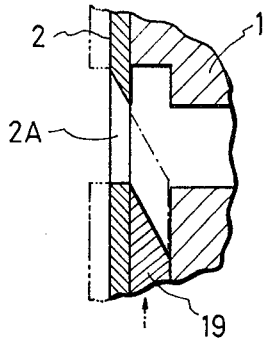
FIG. 5 is a magnified view of a part of the tip portion in FIG. 3.

To further explain the embodiment of the present invention with reference to the drawings, the reference numeral 1 denotes a pistol-type body in which a pad plate 2 can be fitted to the tip and a trigger part 4 given a returning force by a resilient, for example, plastic spring 3 is pivoted with a pin 5 as a fulcrum. As exemplified in FIGS. 4 and 5, the pad plate 2 is provided with a hole portion 2A passing the free end portion of the binding band. The upper inside of the hole portion 2A may be blade-shaped. Further, by varying the thickness of the pad plate 2 as indicated by the two-point chain lines, the cut remaining length projecting out of the socket part of the band when cut can be adjusted.

Figure 1:
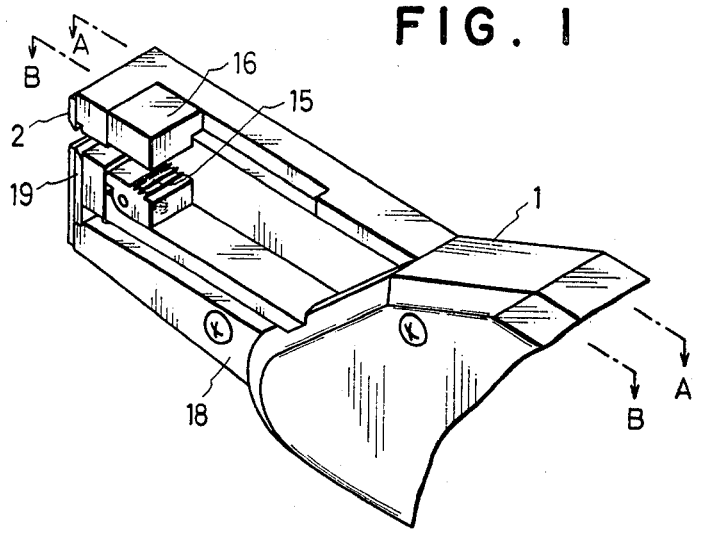
FIG. 1 is a perspective view of a vicinity of a tip portion.
Figure 2:
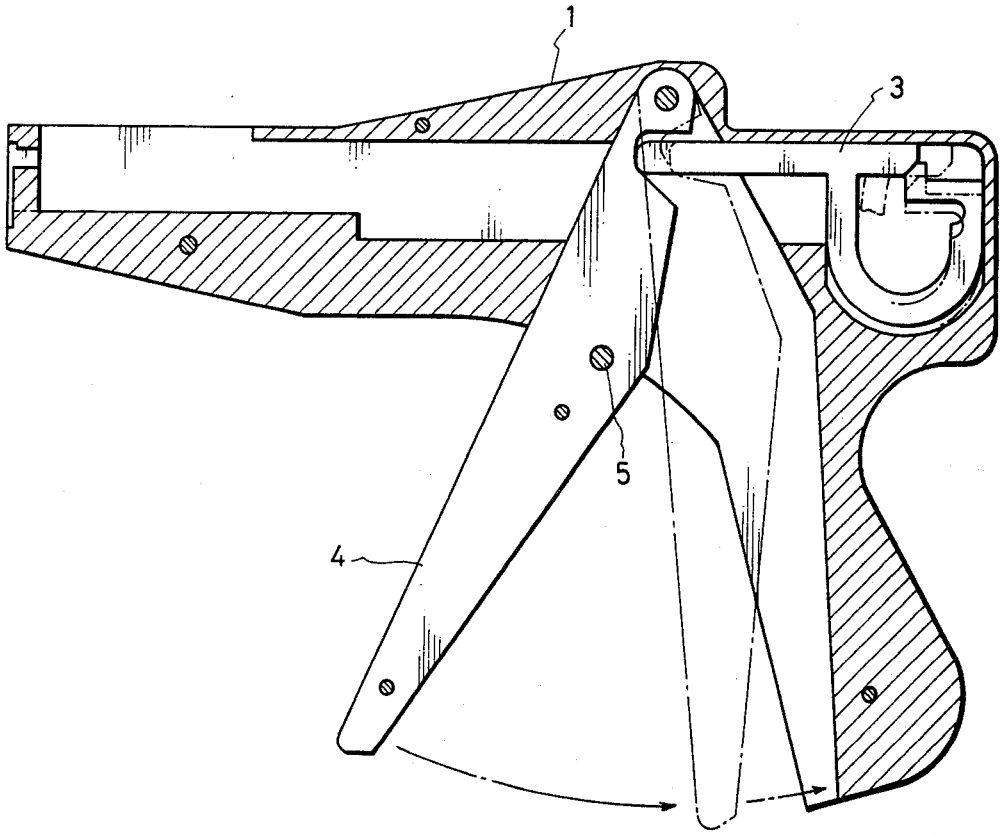
FIG. 2 is a general sectioned view on line A—A in FIG. 1.
Figure 3:
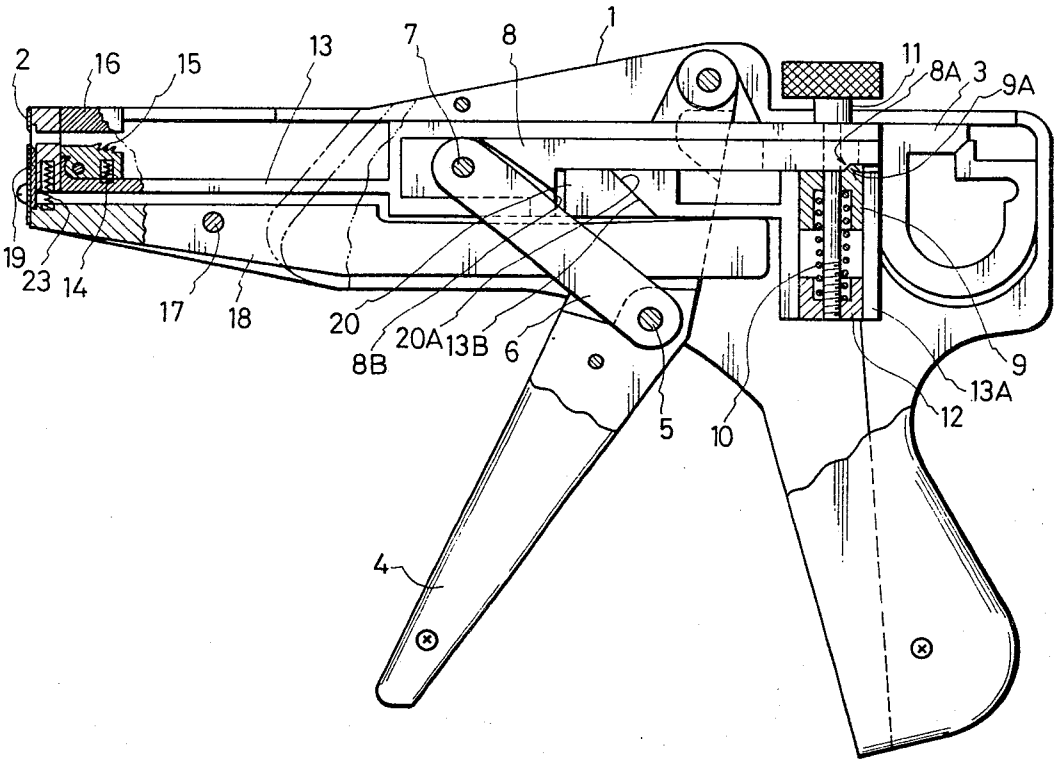
FIG. 3 is a general sectioned view on line B—B in FIG. 1.

As exemplified in FIG. 2, the plastic spring 3 is set as somewhat compressed and deformed within the body 1 and contacts at the tip with the trigger part 4 as strengthened in the returning force. Further, the rear end portion of the plastic spring 3 is split. As in the illustration, both end portions of the spring 3 adjacent the split are provided with tapered parts contacted with each other so that a force strongly pushing up the tapered surfaces will be given by the elastic deformation and will reinforce the force of returning the trigger part 4 to the original position.

By the way, in case the deformation of the plastic spring 3 exceeds tapered contact surface, the elastically deforming force of the contact part will not act but only the inherent elastically deforming force of the plastic spring 3 will act. That is to say, by making the contour of the plastic spring 3 as mentioned above, the returning force of the trigger part 4 can be averaged.

Further, the trigger part 4 is pivoted to one end of a connecting member 6 by the pin 5 and the connecting member 6 is pivoted at the other end to a sliding member 8 sliding within the body 1 by a pin 7. A tapered surface 8A is formed in the rear end portion of the sliding member 8 and is borne by a push-up member 9 having at the top end a tapered surface 9A contacting the tapered surface 8A and given a push-up force by a spring 10. This spring 10 is disposed between an adjusting screw 11 and a nut 12 screwed to the tip of it so that, by rotating the adjusting screw 11, the nut 12 will move vertically and the strength of the push-up force of the spring 10 will be able to be adjusted. Further, the above mentioned push-up member 9 and nut 12 are borne by the rear end portion 13A of a pulling member 13 moving within the body 1. The pulling member 13 is provided in the tip portion with ratchet pawls 15 having a spring 14 and a locking part 16 opposed to them. The locking part 16 is a lateral projection integrally formed on pulling member 13.

Further, a rocking member 18 pivoted by a pin 17 is disposed below the above mentioned pulling member 13 and is provided at the tip with a cutter sliding on the inner surface of the pad plate 2 fitted to the tip of the body 1 and with a compression spring 23. On the upper surface of the rear end portion of the rocking member 18, a push-down member 20 having a sloped surface 20A is arranged movably vertically and slidably on the rocking member 18 and has a gap from a pressing surface 8B between the pressing surface 8B of the above mentioned sliding member 8 and a sloped surface 13B of the pulling member 13 and a sloped surface 20A is contacted with the sloped surface 13B formed in the pulling member 13.

In the drawings, the reference numeral 21 denotes a material to be bound, 22 denotes a binding band, 22A denotes a socket part and 22B denotes a free end portion.

Figure 7:
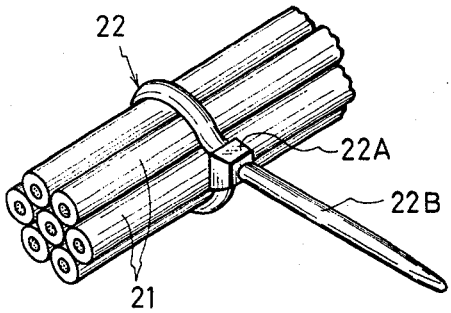
FIG. 7 is a binding band fastening state explaining view.
Figure 6:
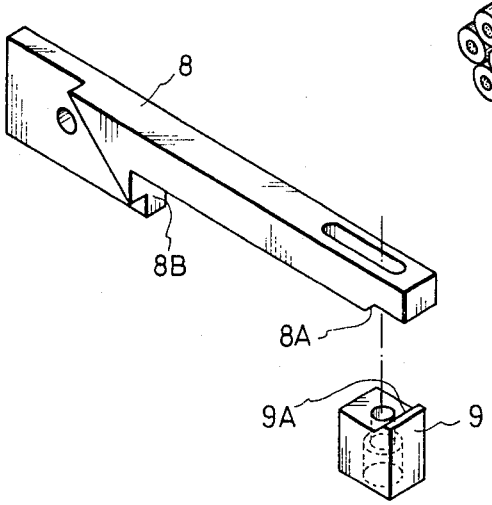
FIG. 6 is a perspective view showing the relation between a sliding member and push-up member.
Figure 8A:
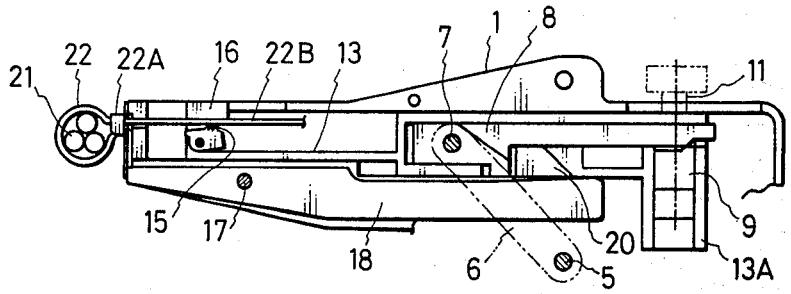
FIGS. 8A to 8D are explanatory views showing operating states.
Figure 8B:
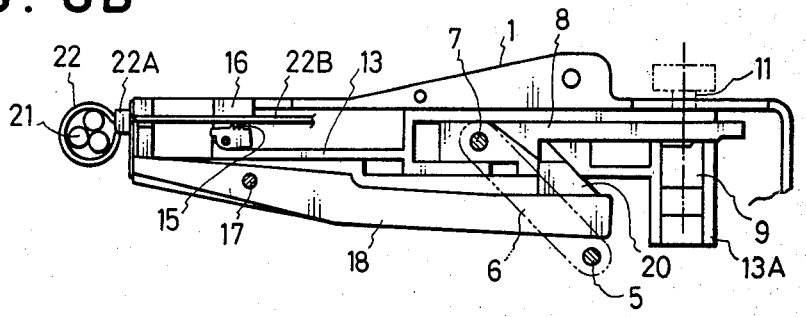

The operation of the present invention shall be described in the following. When the binding band 22 is wound on such materials 21 as, for example, electric cables and in the free end portion 22B is inserted through the hole portion 2A of the pad plate 2 as in FIG. 7 and FIGS. 8A, 8B and the trigger part 4 is pulled as indicated by the arrow in FIG. 2, the rear end portion 13A of the pulling member 13, that is, the pulling member 13 will be moved away from the tip of the body 1 as in FIG. 8A through by means of the connecting member 6 and sliding member 8 and thereby the ratchet pawls 15 provided in the tip portion of the pulling member 13 will engage the free end portion 22B of the band 22 between the pawls and the locking part 16 by the action of the spring 14. When the trigger part 4 is further pulled, the force of the pulling member 13 to pull the band 22 and the force of the push-up member 9 subjected to the force of the spring resisting so as not to be disengaged from the tapered surface 8A of the sliding member 8 will be unbalanced with each other, the push-up member 8 will retreat, the movement of the pulling member 13 will stop and the sliding member 8 will somewhat move.

Figure 8C:
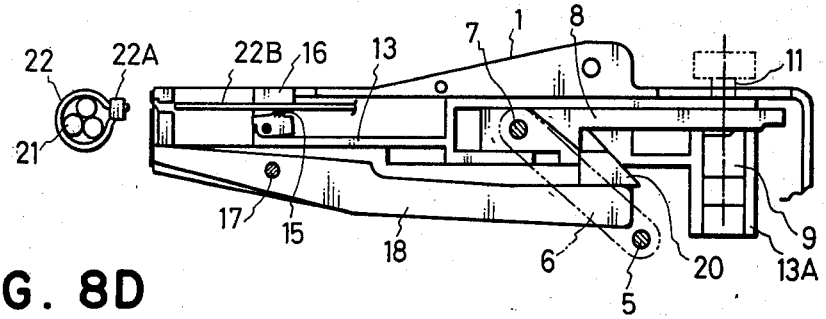

In such case, if a tensile stress acts on the band 22, the pulling member 13 will be momentarily somewhat pulled back, the band will perfectly engage with the socket part, the gap between the pressing surface 8B of the sliding member 8 and the push-down member 20 will contract and the stress acting on the band 22 will be relaxed. When the trigger part 4 is further pulled, the pulling member 13 will not move, the sliding member 8 will move, the pressing surface 8B will contact the push-down member 20 and the push-down member 20 will be compressed between the sliding member 8 and pulling member 13. However, as the push-down member 20 and pulling member 13 are contacted with each other in the tapered parts, the compressing force will act to push-down the push-down member 20 (FIG. 8B), therefore the rocking member 18 will be pushed down in the rear end portion, will rock against the compression spring 23 with the pin 17 as a fulcrum, will push up the cutter 19 at the tip and will slide the blade-shaped portion of the pad plate to cut off the band 22 in the free end portion 22B (FIG. 8C).

Figure 8D:
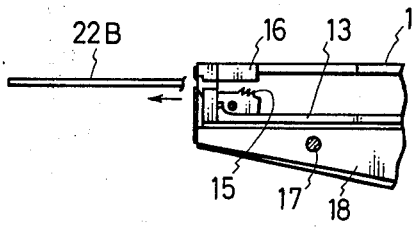

When the trigger part 4 is released, the rocking member 18 will push up the push-down member 20 to return to the original state by the action of the compression spring 23, all the actions will return to the original states due to the spring 3 and the cut free end portion 22B of the band 22 will be discharged out of the tip (FIG. 8D).

By the way, by properly determining the thickness of the pad plate 2 at the tip of the body 1, the band 22 can be normally and positively engaged with the socket part 22A with some space in the projection out of the socket part 22A.

Further, in case the upper inside of the hold portion 2A of the pad plate 2 is blade-shaped, the cutter 19 will be able to be expected to operate more smoothly to cut accurately.

As described above, according to the present invention, as the pulling force is once relaxed just before the band is cut off after being fastened and pulled, the band will be prevented from returning and will be bound positively. Further, as the cut portion of the free end of the band can be positively projected out of the socket part, the operation will be able to be improved and rationalized.

I claim:

1. A binding tool for fastening and cutting off a band after relaxing of a pulling force comprising:

a pistol-type body capable of being fitted with a pad plate at the tip;

a trigger part subjected to a returning force;

a pulling member slidably disposed in said body and having a tip provided with ratchet pawls and a locking part opposite the pawls;

a sliding member slidably disposed along a slot of said pulling member and connected to said trigger part through a pivoted connecting member and having a tapered surface near its rear end portion;

a push-up member having a tapered surface at the top, said surface being slidably contacted with said tapered surface of said sliding member and having a surface slidably contacting an inner surface of the rear end portion of said pulling member, the contacting of said tapered surfaces of said push-up member and said sliding member being released when forces imposed reach a predetermined value;

a rocking member provided at the tip with a cutter and pivoted to said body; and a push-down member having a sloped surface slidably contacted with a sloped surface provided in the lower portion of said pulling member, a face slidably contacting the upper surface of said rocking member, and a face coming into slidable contact with a pressing surface provided at an under side of said sliding member after releasing from contact the tapered surfaces of said sliding member and said push-up member.

2. A binding tool according to claim 1, wherein said trigger is forwardly biased by a plastic spring, said push-up member is adjustably biased perpendicular to the axis of said pulling member by a spring, and said rocking member is biased by a spring.

* * * * *